US007343961B2

(12) United States Patent
Arvedi

(10) Patent No.: US 7,343,961 B2
(45) Date of Patent: Mar. 18, 2008

(54) PROCESS AND PRODUCTION LINE FOR MANUFACTURING ULTRATHIN HOT ROLLED STRIPS BASED ON THE THIN SLAB TECHNIQUE

(76) Inventor: Giovanni Arvedi, Via Mercatello 26, 26100 Cremona CR (IT)

( * ) Notice: Subject to any disclaimer, the term of this patent is extended or adjusted under 35 U.S.C. 154(b) by 460 days.

(21) Appl. No.: 10/501,663

(22) PCT Filed: Aug. 28, 2003

(86) PCT No.: PCT/IT03/00523

§ 371 (c)(1),
(2), (4) Date: Jul. 15, 2004

(87) PCT Pub. No.: WO2004/026497

PCT Pub. Date: Apr. 1, 2004

(65) Prior Publication Data

US 2005/0155740 A1 Jul. 21, 2005

(30) Foreign Application Priority Data

Sep. 19, 2002 (IT) ..... MI2002A1996

(51) Int. Cl.
*B22D 11/12* (2006.01)
*B22D 11/16* (2006.01)

(52) U.S. Cl. ..... 164/452; 476/417

(58) Field of Classification Search ..... 164/452, 164/476, 477, 417

See application file for complete search history.

(56) References Cited

U.S. PATENT DOCUMENTS 5,634,257 A * 6/1997 Kajiwara et al. ..... 29/527.7
6,276,436 B1 8/2001 Pleschiutschnigg ..... 164/476
6,511,557 B2 * 1/2003 Arvedi ..... 148/546
6,616,778 B1 * 9/2003 Bodin ..... 148/541

FOREIGN PATENT DOCUMENTS

| | | | |
|---|---|---|---|
| GB | 2 327 375 | | 1/1999 |
| GB | 2 327 375 A | * | 1/1999 |
| WO | WO 99/29446 | | 6/1999 |
| WO | WO 00/20141 | | 4/2000 |
| WO | WO 00/59650 | | 10/2000 |
| WO | WO 00/59650 A1 | * | 10/2000 |

* cited by examiner

*Primary Examiner*—Kevin P. Kerns
(74) *Attorney, Agent, or Firm*—Lucas & Mercanti, LLP

(57) ABSTRACT

Ultrathin hot rolled steel strips are obtained from thin slabs using a continuous casting process and production line. The process and production line includes a secondary cooling system, a roughing mill, an induction heating zone to fix temperatures of the intermediate strip chosen between 1000 and 1400° C., a final rolling zone to reduce the thickness of the hot finished strip while keeping a controlled temperature of the hot rolled strip from the last stand of the finishing rolling mill higher than 750° C. The strip is cooled between the last stand of the finishing rolling mill and the coiling station using a specific T.T.T diagram (time-temperature-transformation) for steel quality and strip thickness. A control system is also provided with a master system and six further peripheric sub-systems.

24 Claims, 6 Drawing Sheets

22.5
V5
15
16.1
22.6
V6
5.3
8.1
22.4
V4
8
9
12-12.1
11
22.2
V2
10
5
25-10mm
5.3
6.1
5.2
6
22.3
V3
5.1
3.2
3.3
2
2.3
2.2
1
3.1
V1
22.1
3
7
7.1
T>1100°C
Tc<1450°C
7.2
3b
3c
3A
3B
3a
18.2
5-0.6 m/s
1300°C
Example of continuous rolling
30-8mm
13-40 m/min
0.2-0.7 m/s
36 m/min
0.6 m/s
10 mm
80-40 mm
4-10 m/min
0.066-0.166 m/s
7.2 m/min
50 mm 1400
1300
1200
1100
1000
900
800
700
Hot strip temperature in °C
1st Pass
10/5 mm
2nd Pass
5/3 mm
3rd Pass
3/1.5 mm
4th Pass
1.5/0.9 mm
5th Pass
0.9/0.7 mm
AC3
AC1
10
5
0
Strip thickness in mm 1500
1400
1300
1200
1100
1000
900
800
700
Hot strip temperature in °C
1st Pass
10/5 mm
2nd Pass
5/3 mm
3rd Pass
3/1.5 mm
4th Pass
1.5/0.9 mm
5th Pass
0.9/0.7 mm
AC3
AC1
0
10
20
30
Time interval between induction heating
and exit from the 5th stand in seconds

PROCESS AND PRODUCTION LINE FOR MANUFACTURING ULTRATHIN HOT ROLLED STRIPS BASED ON THE THIN SLAB TECHNIQUE

BACKGROUND OF THE INVENTION

1. Field of the Invention

This patent application claims the benefit of priority from Italian Patent Application No. MI12002A 001996 filed Sep. 19, 2002 through PCT Application Ser. No. PCT/IT2003/000523 filed Aug. 28, 2003, the contents of which are incorporated herein by reference.

The present invention relates to a process, as well as the corresponding production line, for manufacturing ultrathin hot strip, being rolled through a thermo-mechanical means to thicknesses down to a minimum of 0.4 mm based on the thin slab technology.

2. Description of Related Art

It is known that the so-called "thin slab" technique for manufacturing hot rolled strip has been strongly developing from the time of the first plants of this type in USA and Italy starting since years 1990 and 1992.

At present with this thin slab technology can already be produced as hot strip whichever quality of steel, both in the field of carbon steels and in that of stainless steel. The state of the art is described by way of example in DE 3840812C2, EP 0415987B1, DE 19520832A1 and WO 00/20141. Under a more attentive examination it appears that a hardly controllable parameter is the temperature: at a casting speed of 4-6 m/min and hot strip thickness <2 mm temperatures of the intermediate strip <900° C. (AC3) are measured at exit from the roughing mill and strip temperatures <750° C. (AC1) at exit from the finishing mill, which cause quality inconveniences as to the properties of the material and the production safety.

In order to avoid going below these critical temperatures, the thickness of the intermediate strip after the roughing or high reduction mill HRM at casting speeds of 4-6 m/min cannot be less than 20 mm. This value of the intermediate strip thickness leads e.g., after passing through the induction heating zone and reaching a strip temperature of about 1200° C. at the furnace exit, again to limits of the hot finished strip thickness, limits that it is impossible to exceed downwards without also reaching at the same time temperatures lower than AC1 temperature of 750° C., such as in case of a carbon steel with 0.06% C, with consequent drawbacks in the steel quality.

It is also known after ten years of productive experience and developments of the thin slab technique, that the trade demand has to be met with a hot rolled strip product of better quality and at lower costs. The requirements of the market for a hot rolled strip are directed in particular to a minimum thickness of 0.4 mm and at the same time a thermo-mechanical rolling in the meaning of the T.T.T. diagram, leading to the desired and improved mechanical characteristics of the material. In this context a low-cost production of Dual Phase, TRIP and TWIP steels production has been taken into consideration, in the best technical way by means of the thin slab technique.

BRIEF SUMMARY OF THE INVENTION

An object of the present invention is that of developing a combination of process and production line based on the thin slab technique by means of a hot strip finishing mill, such as to allow the manufacture of ultrathin hot strip, 0.4 mm thick as minimum with a maximum width of 2.2 mn in a thermo-mechanical way according to the T.T.T. diagram, having a controlled crystal structure, and consequently controlled properties of the material.

Another object of the invention, in addition to the standard production of hot strip wound in coils with specific weight of about 20 Kg/mm width, is the so-called "continuous rolling" of the above-mentioned high quality hot strip, allowing for any weight of the coil and also a direct connection with the subsequent working steps.

A further object of the invention is to provide also a secondary cooling system in the casting machine during the liquid core reduction.

The above-mentioned objects arc achieved in particular by means of the features, non obvious in the art.

BRIEF DESCRIPTION OF THE DRAWINGS

The present invention will be now described with reference to the annexed drawings, given by way of non-limiting example, in which.

DETAILED DESCRIPTION OF THE INVENTION

Figure 1A:
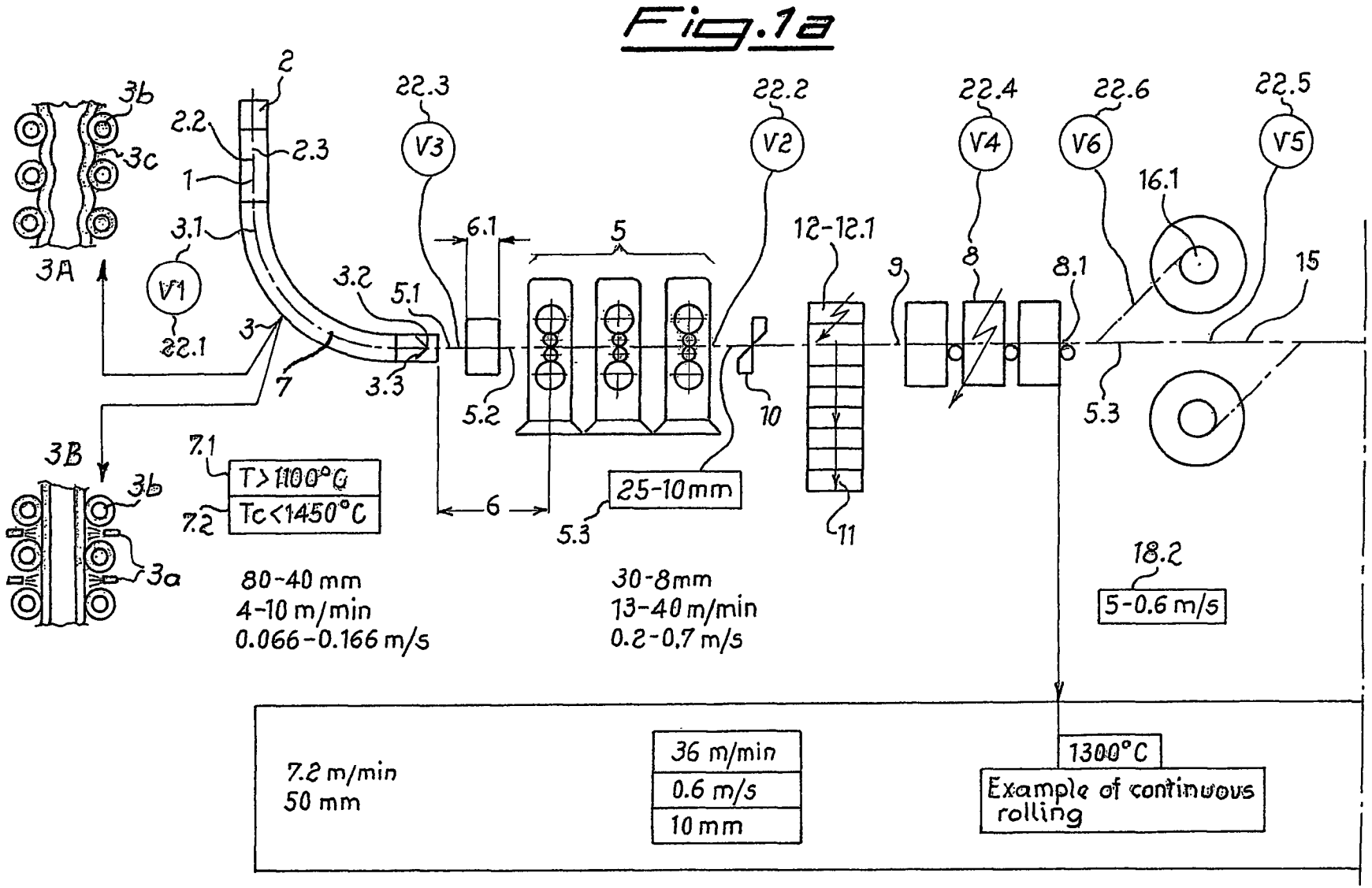
FIGS. 1*a* and 1*b* schematically show, combined together, the preferred example of productive line for the process according to the invention.
Figure 1B:
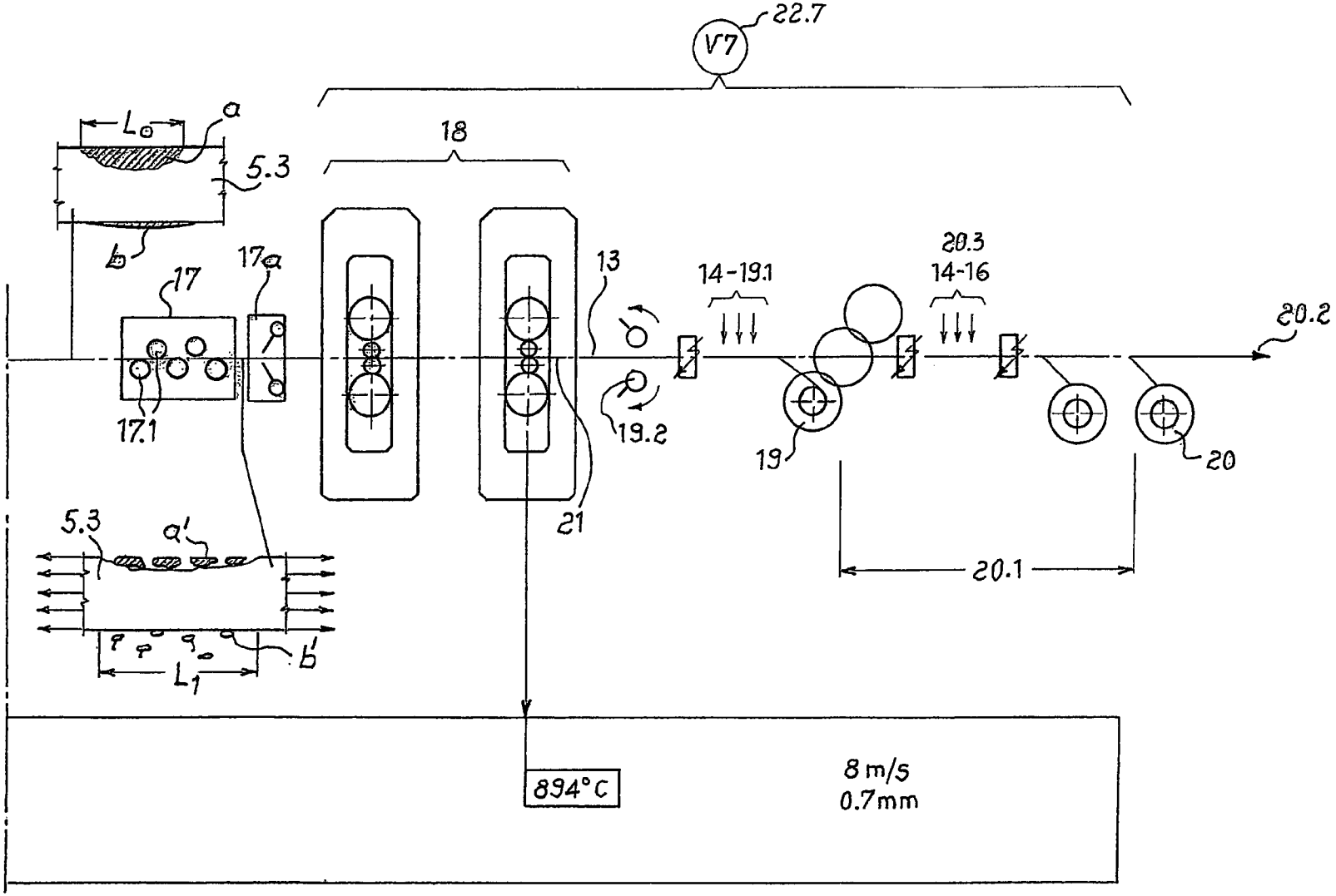

With reference to FIGS. 1*a* and 1*b*, a preferred productive line according to the invention, capable of carrying out the inventive process, is represented in its components. There is present, at the beginning of the line, a continuous casting system 1 with oscillating mould 2 that feeds at its outlet, with a maximum casting speed of 10 m/min, a slab with a width of 800-1200 mm and a thickness of 100-70 mm. Downstream of the mould a roller path (or table) 3 is provided, mechanically arranged to reduce by 60% at maximum the slab thickness in the zone 3.1 during the solidification and up to 80-40 mm in the zone 3.2 with a casting speed that should constantly be kept at its maximum values to obtain the best productivity and the highest slab temperature at the exit from the casting machine.

It has been found that the mould will preferably have a geometry such that on leaving it the slab shows a not perfectly rectangular section, but with a central crown of a value preferably between 0.5 and 5 mm at each side 2.2. The subsequent pre-strip, after solid core rolling, will preferably still have a central crown of up to 0.4 mm at each side 2.3.

A specific hardware device with relative software may be provided in order to obtain the geometrical tolerances required by this strip, so as to contain the thickness variations of the slab leaving the continuous caster within the range of values of ±1 mm, irrespective of roll gaps and wear. For this purpose an active position actuator/regulator and parallelism control combined with the first part of the casting machine may be provided.

This means that the end of solidification, in zone 3.3 is to be found at the end of the continuous casting machine.

Figure 2:
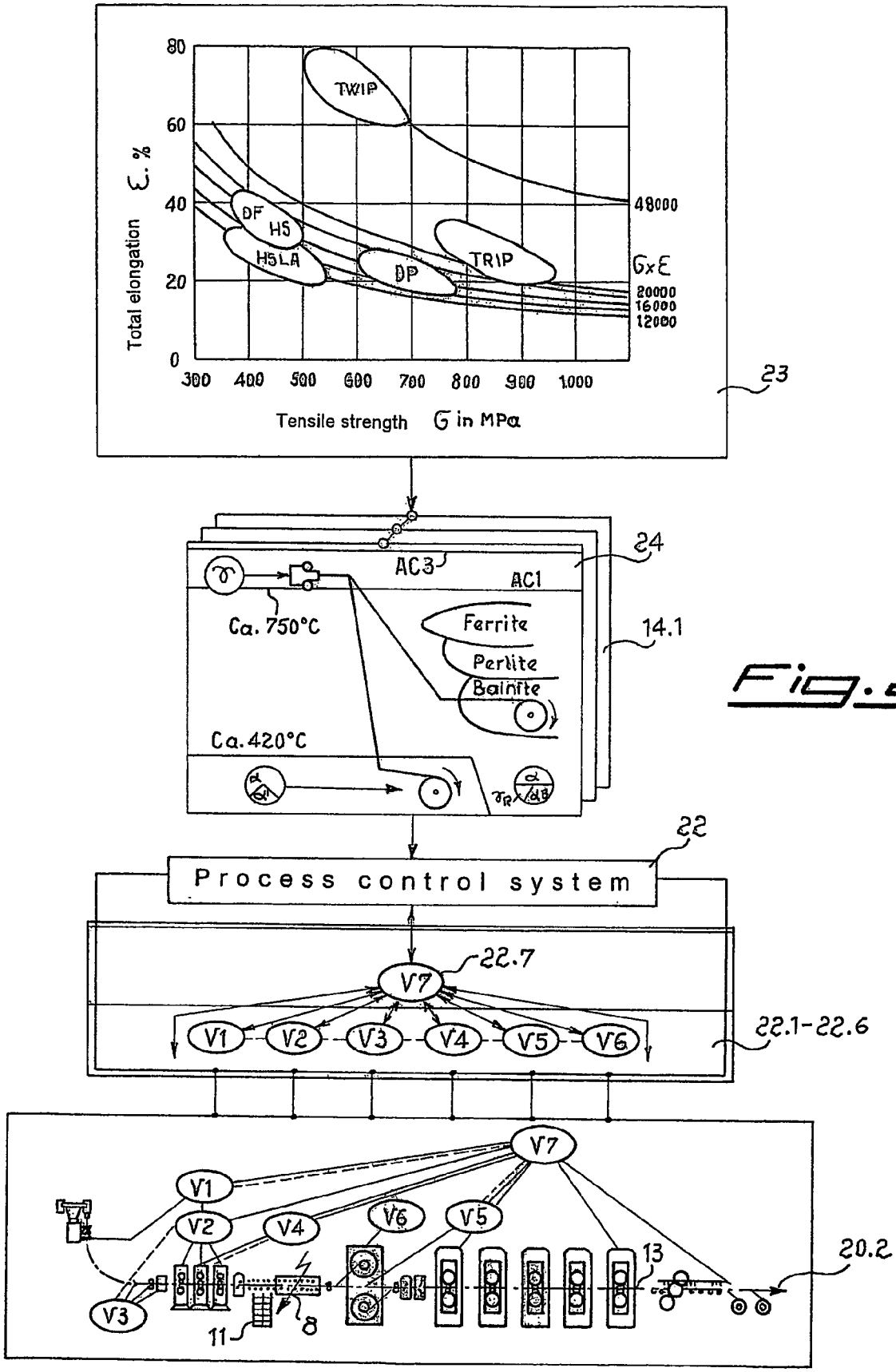
FIG. 2 schematically shows a preferred embodiment of the system controlling the process.

A reduction of the above-mentioned slab thickness during the solidification is considered as the most important technical advantage of the process and the relevant quantity is referred to as parameter V1, being also indicated as datum 22.1 of the control system, with reference to FIG. 2. It is in fact a consequence of said values of thickness reduction the achievement of a fine crystal structure and a reduced inner cracks and segregation, thereby resulting in improved characteristics of the material. Furthermore the slab thickness reduction can be chosen so as to optimize the conditions in the whole manufacturing process.

An important point to achieve at this stage of the process was to develop a particular type of air/water secondary cooling 3B, specially studied in combination with the liquid core reduction process of the point 3. The aim of this process was to achieve a temperature variation of ±30° C. along both the external surfaces in contact with the casting rolls 3*b*, in order to obtain a temperature distribution as homogeneous as possible, essential to achieve the internal quality conditions as above-mentioned, thanks above all to a reduction of the bulging effect 3A-3*c* to a minimum, at high casting speeds (up to 8 m/min) and an exit temperature below 1200° C. in order to prevent phenomena of enlargement of the austenitic grain with negative effects on the product quality during rolling.

As regards intensity, suitable specific volumes of water must be ensured, quantifiable in 0.6-3 l/kg of product, while the cooling density (l/min per $m^2$) must be greater in the upper part of the casting machine, where slab temperatures are higher, cooling water vaporization is stronger and the skin still relatively thin, which is why the transmission of heat with the liquid core is facilitated. "Air-mist"-type nozzles 3*a* will preferably be used.

Temperature homogeneity on the perimeter of each transversal cross-section may be obtained by suitably choosing the number of nozzles 3*a* and their spray pattern in the space between each pair of opposite rolls. Selective control of the delivery of the nozzles between the front side and back side of the slab must also be provided, by increasing the back side delivery in order to compensate for the lack of stagnation phenomena in the concave area between the front side rolls and the slab. For the same purposes it will also be useful to carry out selective dynamic control on some of the nozzles in each area between successive rolls, while observing for example the upper and/or lower slab surface temperature on the transversal sections, for example by means of an infrared scanner.

For temperature homogeneity in the longitudinal section, dynamic control of the total delivery and/or the distribution of the cooling density along the casting machine is carried out in order to keep the desired temperatures of the slab surface constant in one or more detection points along the casting machine. It is to be noted that the temperatures in this direction may be affected by numerous parameters such as casting speed, the liquid steel casting temperature, the entity of thermal exchanges in the mould and the chemical composition of the cast steel. The expected slab surface temperatures are calculated with suitable solidification models which consider:

- steel chemical composition;
- sensitivity of the steel to internal deformation (bulging);
- sensitivity of the steel to thermal gradients (possible internal or surface cracks in the transversal or longitudinal direction);
- geometrical characteristics of the casting machine;
- foreseen casting speeds;
- foreseen metallurgical lengths.

To this effect the secondary cooling system is provided with various nozzle areas controlled by area valves for water and/or air in the case of air-mist, which in the upper part of the casting machine may include nozzles both on the front side and the back side, while in the lower part they may be differentiated between front side and back side. These valves may control only some of the nozzles present in each of the spaces between the rolls so as to have more than one active control of cooling in the transversal direction.

The slab 2.2 is directly fed, at the exit of the continuous casting apparatus, to a roughing mill (or HRM) 5 in order to be rolled to a thickness of 30-8 mm in not more than four passes. The thickness reduction to be obtained by rolling is so determined to have the best conditions for the process in its whole. Furthermore the relatively slow speed of 4-10 m/min, when entering 5.1, i.e. 0.066-0.166 m/s, causes a rather sensible broadening of the rolled product or "slab" 5.2, and thereby a highly improved profile, symmetrical in a transverse direction with deviations of less than 1%. Such a good profile of the intermediate strip 5.3 is actually a basic condition for having a good profile of the finished product 13, in other words of the thin hot rolled strip, with a thickness of 1.5-0.4 mm.

The good quality of the intermediate strip 5.3 profile, under condition of the low rolling speed in 5.1 when entering HRM 5 can be cited as the second technical advantage V2 of the process, capable of strongly influencing the flexibility of the whole process and the product quality. The same datum can be indicated as parameter 22.2 in the control system 22 described in the following with reference to FIG. 2.

By keeping preferably low the distance 6 between the continuous casting machine 1 and the entry into HRM 5 e.g. comprised between 0.5 and 4m, the slab 2.2 which is solidified at the end of the roller table 3 is fed forward in the roughing mill with a temperature of 1450° C., near the temperature of steel solidification 7.1, in its most inner region 7, thereby with a "hot core" as it is usually said, while the temperature at the surface is of 1150° C. Such an inverted gradient of temperature 7.2 of the slab 2.2 on half thickness of the slab itself at the entry of HRM 5 allows for a more homogeneous and uniform transformation throughout the thickness of the material to be rolled 5.2, since also the so-called "core" is transformed more homogeneously. This also appears from the edges of the material to be rolled, which are convex and well defined at the exit from HRM 5.

The product to be rolled or slab 5.2 with its inverted temperature gradient 7.2, also contributes, by directly entering the roughing mill 5, to the fact that the properties of the material, as well as the profile of the intermediate strip 5.3 and of the final hot rolled strip, are highly improved.

This "inverted temperature gradient" 7.2, up to now totally unusual in the rolling technology—that is based commonly on a constant distribution of the temperature throughout the thickness of the slab with a maximum variation of 30° C., in this case the inner core being colder than the surface—leads to positive characteristics in the finished product and can be taken into consideration as third technical advantage V3 of the process (22.3 with reference to the control system of FIG. 2).

On the contrary, with a higher distance 6.1 between the continuous casting machine 1 and the entry into HRM 5, such as up to 350 m to allow the introduction of a compensation furnace (preferably a continuous roller furnace) to compensate the temperature of the material to be rolled or slab 5.2, the so-called third advantage V3 corresponding to the temperature inverted gradient 7.2 as above defined is lost.

After passing through the roughing mill HRM 5, the intermediate strip 5.3 with a thickness 30-8 mm, according to the best conditions for the process in the all, directly enters an induction heating path 8. The distance between the exit from HRM 5 and the entry into the induction heating 8 should be designed as short as possible to reduced the temperature losses, so as the temperature of the intermediate strip 9 will not become lower than AC3, i.e. about 900° C., thus leaving the austenitic area of crystallization.

The distance between the exit of HRM and the entry of the induction heating 8 should be equipped with a device of transverse separation, preferably a shearing device 10, and for reasons of safety in order to obviate breakdowns in the rolling mill, with a transverse transportation device 11. The plate-shaped sheets, being cut in case of breakdown, already show sufficient properties of the material and therefore can be sold. In order that the temperatures losses of the intermediate strip 5.3 are as small as possible in the zone of the transverse transportation line, there should be provided a tiltable cover 12 for its insulation or even a tiltable cover with possibility of induction heating 12.1 between the shears 10 and the entry of the induction heating path 8.

When passing throughout the induction heating pass 8 the intermediate strip 5.3 is fed with a thickness between 30 and 8 mm according to the desired hot rolled strip 13 in view of the programmed thermo-mechanical rolling 14 as seen in the T.T.T. diagram 14.1 (see FIG. 2), when bearing in mind the thickness of the hot rolled strip and the type of structure at the temperature between 1100° C. and 1400° C. Such a flexibility in managing the temperature can be reached only through an induction heating, whereas a furnace fed by primary energy is slow and its temperature cannot change from a hot strip to another.

Advantageously, according to the inventions, a regulation algorithm is provided for the overheating of the pre-strip 5.3 (head and tail), and in particular the temperature control which involves the induction furnace 8.

Practical tests have in fact shown that a controlled overheating of both the head and tail of the intermediate strip is of great help in finishing mill rolling for preventing cobbles and obtaining the best product tolerances, especially in the manufacture of ultrathin products (<1 mm).

Such a flexibility in managing the temperature of the intermediate strip by means of the induction furnace 8, in order to ensure an optimized thermo-mechanical rolling in the meaning of the diagram T.T.T., can be identified as a fourth technical advantage V4 of the process (corresponding to parameter 22.4 in the control system according to FIG. 2).

The process according to the invention, with the relevant production line, allows to choose either a "continuous rolling" 15 or even a standard rolling to coils 16 with specific weights of the coil, e.g. of 20 kg/mm of strip width. In case of "continuous rolling" 15 the intermediate strip 5.3 enters the finishing rolling mill 18 at the desired temperature, as it has been fixed in the induction furnace 8 between 1100° C. and 1400° C. (8.1) and at an entry speed which is bound to the casting speed 2.3 and is the same as the speed at the exit from HRM throughout a plastic stretching device 17 and a descaling device 17*a*.

Plastic stretching device 17 causes lengthening, referred to a section of initial length $L_o$, equal to:

$$E=(L_I-L_o)/L_o$$

Associated with the stretch, which gives rise to this lengthening, is a plastic bending due to the passage through the rolls 17.1, which leads to the breaking of the adherent scale a-b and the rolled-in scale, much less ductile and more fragile than the steel, above all in the temperature range between 600 and 1300° C. Broken in this way, as shown in FIG. 1*b* with a' and b', the scale is completely removed in a subsequent descaling step 17*a* downstream of the device 17, so the pre-strip 5.3 presents itself at the entry to the finishing mill 18 with a surface free of any type of scale. It is therefore possible, after the finishing mill 18, to obtain a product free of surface defects.

It is to be noted that the above-mentioned plastic bending is achieved preferably by also providing a relative penetration movement between the upper and lower rolls 17.1, such as to produce bending in plastic conditions which ensures a stretching of the material of more than 2%. For this purpose a control system for the position of the rolls 17.1 and the force impressed by the device 17 can be provided. This control system preferably includes means able to keep stretching of the material within acceptable values (<0.7%) of length variation, by using a mass flow variation measuring device, obtained by means of two encoders connected to the entry and exit of the device 17.

The continuous rolling 15 requires a carousel coiler 19 with pre-heating 19.1 and shears 19.2, preferably flying shears immediately after the exit from the finishing mill 18 at a distance of about 20-30 m near the standard downcoiler station 20 with a laminar cooling provided upstream on a runout table 20.1 about 60 m long. The continuous rolling also allows, with a corresponding adaptation of the plant, for a direct connection with the subsequent working step 20.2 such as pickling, cold rolling or galvanizing system.

The above-mentioned "continuous rolling", the direct connection of the continuous casting machine 1 and roughing mill 5 with a finishing mill 18, assisted by the induction heating 8, can be cited as a fifth technical advantage V5 of the process (parameter 22.5 in the control system 22 of FIG. 2).

The process of the invention with its corresponding production line also provides for manufacturing common coils of hot rolled strip 16 of 20 kg/mm width. When producing coils of hot rolled strip 16 with standard weights of the coil the process, with its production line, allows to vary by hot rolling:

the entry speed 18.2 between 3.3 and 0.6 m/s; and the temperature of the intermediate strip 8.1 between 1000° C. and 1400° C. with the aim of making it possible to manufacture hot rolled strip with different thicknesses and steel qualities from one coil to another, each time under the best conditions, with the aid of thermo-mechanical rolling.

A so high flexibility of the process parameters as to the entry speed of the intermediate strip 18.2 into the finishing mill as well as its temperature 8.1, being conditioned by the induction heating 8, enables a thermo-mechanical rolling 14 in the meaning of the T.T.T. diagram and consequently the production of different qualities of steel and different thicknesses of hot rolled strip from one coil to another. This can be considered as the sixth technical advantage V6 of the process (parameter 22.6 of the control system 22 of FIG. 2).

The above-mentioned six advantages of the technical process with their high flexibility are used as best as possible for the rolling in the finishing mill 18, which consists of six stands at maximum in order to accomplish with an exit temperature 21>AC1 of about 750° C. the management of the controlled thermo-mechanical temperature 14 of the hot rolled strip 13 according to the T.T.T. diagram 14.1, with the thickness of the hot rolled strip 13 being prefixed between a minimum of 0.4 mm and a maximum of 12 mm.

At prefixed values of steel quality and thickness of the hot rolled strip, leading to a specific T.T.T. diagram, during the rolling programmation step the following is determined:

with specific features of material 23 and the T.T.T. diagram 14.1 relating thereto for the thermo-mechanical rolling 14. In the finishing mill area, including the cooling according to the T.T.T. diagram, the master system 22.7 determines the process data to achieve the advantageous objects desired as far as the best quality of the strip and production safety are concerned, as well as concerning the reduced production costs.

Figure 3:
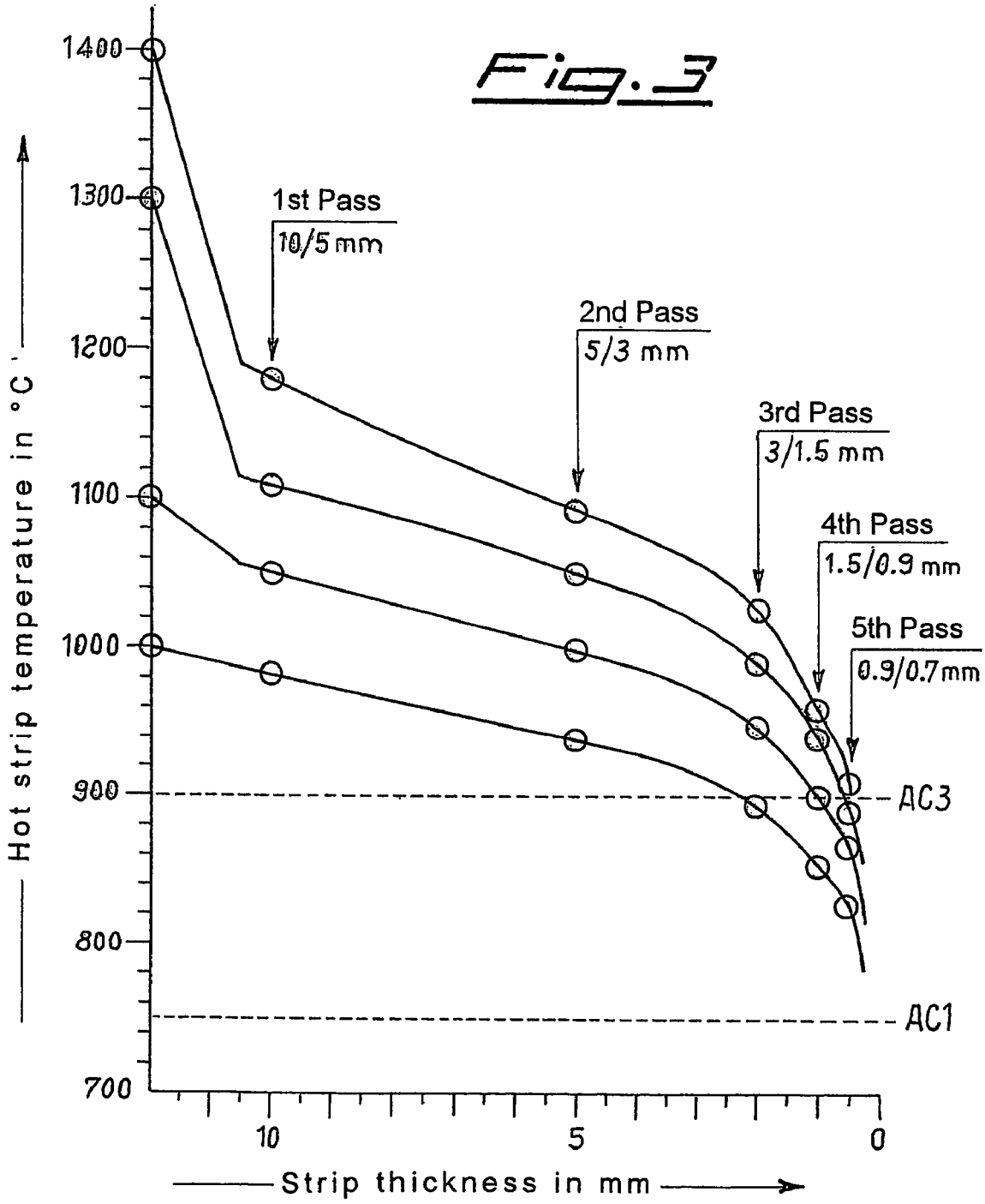
FIG. 3 shows a diagram of strip temperature in function of the strip thickness or the number of rolling passes.
Figure 4:
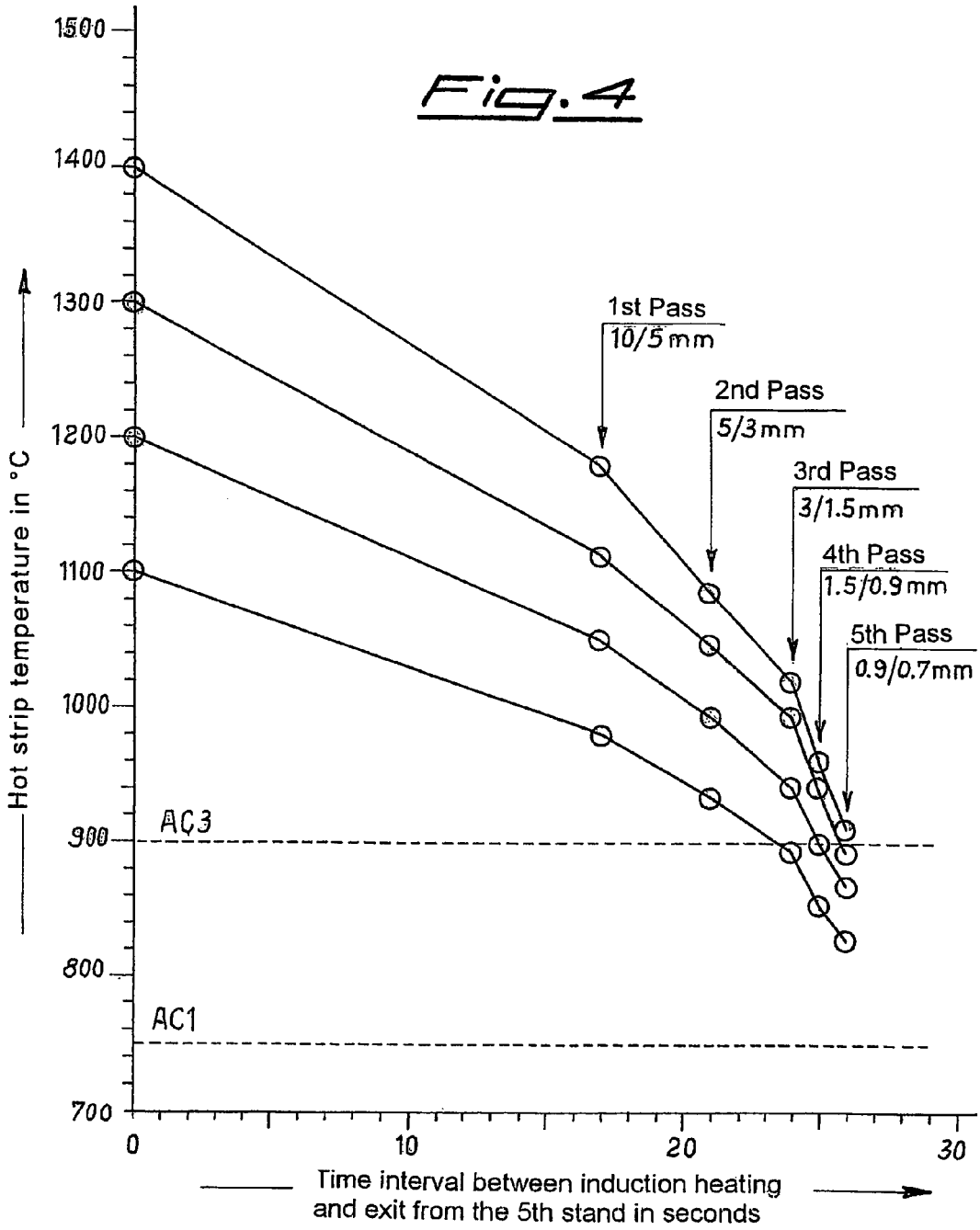
FIG. 4 shows a diagram of the variations of the strip temperatures in function of the sequence of rolling passes in the time.

FIGS. 3 and 4 are obtained on the basis of the following table, that shows a program of passes for the finishing mill 18, with five stands for producing a hot rolled strip being 0.7 mm thick under the conditions of a continuous rolling 15, as well as the corresponding temperature variations of the intermediate strip 5.3 from its leaving the induction heating path 8 to the hot rolled strip with a thickness of 0.7 mm at its exit from the fifth stand of the finishing mill 18 with heat supply equal to zero in the five transformation passes.

| Position | | JH | F1 | F2 | F3 | F4 | F5 | SCC | DC |
|---|---|---|---|---|---|---|---|---|---|
| Distance | m | 10 | 5 | 5 | 5 | 5 | 20 | 60 | |
| Strip thickness | mm | 10 | 5 | 3 | 1.5 | 0.9 | 0.7 | | |
| Speed | m/s | 0.6 | 1.2 | 2.0 | 4.0 | 6.7 | 8.6 | | |
| Time (1:3) | S | 17 | 4.2 | 2.5 | 1.25 | 0.75 | 2.3 | 6.9 | |
| <<Time | | 17 | 21.2 | 23.7 | 24.95 | 25.70 | 28.0 | 34.9 | |
| Temperature | ° C. | 1100 *1 | 982 | 935 | 895 | 855 | 825 | | |
| Cooling speed | ° C./S | 4 | 11 | 16 | 32 | 40 | 50 | | |
| | ° C. | 1200 *1 | 1048 | 995 | 945 | 901 | 864 | | |
| | ° C./S | 6 | 13 | 20 | 35 | 50 | 56 | | |
| | ° C. | 1300 *1 | 1114 | 1047 | 991 | 941 | 894 | | |
| | ° C./S | 8 | 16 | 22 | 40 | 60 | 68 | | |
| | ° C. | 1400 *1 | 1180 | 1086 | 1023 | 960 | 913 | | |
| | ° C./S | 10 | 22 | 25 | 50 | 65 | 71 | | |
| Reduction at | mm | 10/5 | 5/3 | 3/1.5 | 1.5/0.9 | 0.9/0.7 | | | |
| each pass | % | 50 | 40 | 50 | 40 | 22 | | | |

Basic conditions:
Casting speed 7.2 m/min.
Slab thickness 50 mm
HRM 50/10 mm
Continuous rolling
*1) Incl. 50° C. due to descaling
JH—Induction furnace
SCC—Carousel furnace
DC—Standard coiler the cooling strategy;

the programming of passes; in connection with the management of the strip temperature in the finishing mill while including all the six technical areas influencing the process, as described above.

Such a seventh technical advantage of the process V7 (parameter 22.7 in the control system 22 of FIG. 2) with its process parameters will be considered as the main or "master" datum for the best accomplishment of the whole process starting from the continuous casting system 1 until the possible winding stations 19 or 20 in case of continuous rolling or of production of standard hot rolled strip, and dictates the process parameters of the six technical areas of the process as above described, which can also be defined as control systems 22 of the process.

In FIG. 2 the process control system 22 is represented with its master system 22.7 in the finishing mill area with cooling and downcoiler included, as well as the relevant subsystems from 22.1 to 22.6 for carrying out the whole process by the corresponding apparatus. Such a process control system 22 achieves its own data for the qualities of steel to be produced e.g. a Dual Phase or TRIP or TWIP steel FIG. 3 shows the variation of the strip temperature in function of the programmed sequence of passes, or of the strip thickness in mm for different temperatures of the intermediate strip at the exit of the induction heating 8. The diagram clearly shows that when the temperature increases between 1100° C. and 1400° C. the temperature of the strip going out from the fifth stand increases from 825° C. by 88° C. up to 913° C., whereby it is again above AC3 at about 900° C., i.e. in the austenitic zone. By increasing the strip temperature in the induction furnace a higher safety is achieved for the thermo-mechanical treatment according to the T.T.T. diagram.

FIG. 4 shows the strip temperatures in function of the subsequent passes in the time, expressed in seconds, against different temperatures of the intermediate strip when leaving the induction heating path 8. The diagram leads to the same indications as diagram of FIG. 3, but makes still clearer that with a strip thickness reduction the cooling increases more than proportionally according to the Boltzmann radiation law and the conditions for a strip of only 0.4 mm become correspondingly more critical. The purpose is that of maintaining a temperature in the field of values 24 between AC3 and AC1 of 900-750° C., such as for a carbon steel with the composition:

0.15% C
1.50% Mn
150% Si
0.50% Cu and a temperature in the martensitic zone of about 430° C. To this purpose and mainly not to go down below the lower limit AC1, it is possible to intervene by increasing the casting speed in case of continuous rolling and increasing the entry speed 18.2 into the finishing mill in case of standard production of coils.

Figure 5:
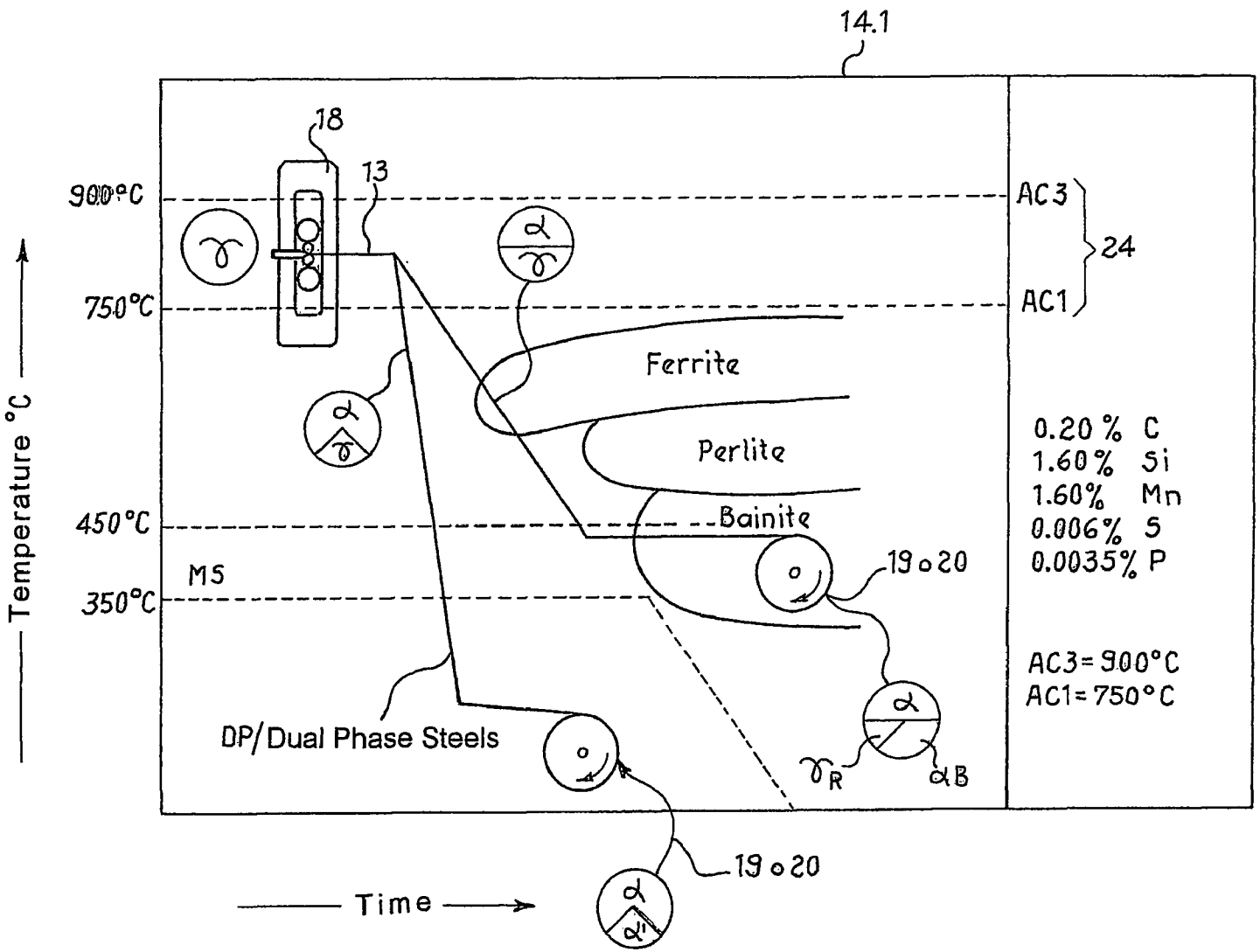
FIG. 5 shows a T.T.T. diagram for a steel analysis in view of the production of a Dual Phase, TRIP or TWIP steel.

FIG. 5 shows a T.T.T. diagram for analyzing a steel by which a Dual Phase steel, either TRIP or TWIP, can be produced by means of a different management of the temperature of the hot rolled strip between the last stand of the finishing mill 18 and the carousel coiler 19 or a standard downcoiler station 20. In case of Dual Phase steel in consequence of the high cooling speed and the enrichment of C in the separation ferrite a temperature of about 250-200° C. is reached with consequent separation of martensite. In case of TRIP steel with the same steel analysis, in consequence of the lower cooling speed, there results a formation of ferrite, bainite and residual austenite.

The T.T.T. diagram also allows to recognize that on the cooling lines between the last stand of the finishing mill 18 and the carousel coiler 19 or the standard downcoiler station 20 in addition to the respective cooling line there should be placed an isolation line and/or an induction heating line 20.3.

From the above it clearly results that the main advantage of the present invention is that of allowing ultrathin hot rolled strip being manufactured with a thickness of down to a minimum of 0.4 mm in high quality steels for the car industry, both of the carbon type and in the field of stainless steels by using the thin slab technique. The process of the invention as described above with its specific production line renders it possible a great flexibility, unknown up to now, of the whole process with its individual operation steps and the corresponding units and apparatuses of the production line, in particular the continuous casting machine 1, the roughing mill HRM 5, the induction heating path 8, the intermediate winding station 16.1 and finishing mill 18 with the cooling line and the coiling reel station, thus allowing e.g. the successful and economic production of Dual Phase, TRIP and TWIP steels. By taking into account the specific T.T.T. diagram for different steel qualities and by means of a process control system 22, cooperating with the control master system 22.7 and six additional control subsystems from 22.1 to 22.6, the thermo-mechanical rolling process 14 can be programmed, guided and controlled in the best possible way within the range of the process parameters starting from the continuous casting system 1 until the hot rolled strip coiler 19 or 20, otherwise until the passage to the subsequent working steps 20.2 for a continuous rolling 15 or a standard rolling of hot coils.

The invention claimed is:

1. Process for the continuous production of an ultrathin hot rolled steel strip from a thin slab obtained by continuous casting in a mould, comprising:

a continuous casting step (1);

a pre-transformation (5) subsequent to the continuous casting step (1);

an induction heating (8); and a final transformation (18) with previous plastic stretching (17), descaling (17*a*) and subsequent cooling and coiling, characterized by:

the slab leaving the mould with a central crown at each side;

a reduction of a slab thickness in continuous casting during solidification (3.1) by 60% at maximum, from 100 to 70 mm, until a reduction from 80 to 40 mm;

a secondary cooling during a liquid steel core reduction step (3B) of the continuous casting step (1), performed by spray nozzles (3*a*), with the following characteristics:

specific water delivery between 0.6 and 3.0 liters per kg of cast steel, decreasing cooling density in the direction of the slab advancement due to liquid core reduction, and selective control of cooling fluid flow rates between a front side and a back side of the slab;

said pre-transformation being a roughing step of the thin slab upon solidification at a surface temperature of the slab >1100° C. with not more than four passes to obtain an intermediate strip (5.3) having different thicknesses chosen in the range from 30 to 8 mm with a central crown of up to 0.4 mm at each side;

said induction heating (8) being adapted to fix various temperatures of the intermediate strip chosen between 1000 and 1400° C. and overheating function of a head and tail;

said plastic stretching (17) combined with descaling (17*a*) to eliminate scale from the surface of the intermediate strip;

said final transformation (18) being a rolling step down to a thickness of a finished strip of 0.4 mm as a minimum with not more than six passes and a controlled temperature of a hot rolled strip at an exit therefrom >750° C. (AC1); and a controlled cooling (14) of a strip (13) in the time between the end of a final rolling (18) and the coiling until a minimum temperature of 200° C., according to a corresponding T.T.T. diagram (14.1) specific for a steel quality of the strip thickness.

2. Process according to claim 1, characterized in that said roughing step (5) occurs directly after the slab solidification with a hot core (7) of the slab at a temperature of less than 1450° C., near the temperature of steel solidification (7.1) higher than 1100° C., thereby with an inverted temperature gradient (7.2) throughout half thickness of the slab.

3. Process according to claim 2, characterized in that immediately after the roughing step (5), the intermediate strip (5.3) is subjected to a crosswise separation step by cutting (10).

4. Process according to claim 3, characterized in that directly after the separation of the intermediate strip, a withdrawal (11) of plate-shaped sheets is possible by means of a cross-wise transportation.

5. Process according to claim 1, characterized in that the intermediate strip (5.3) is either directly guided to said final transformation (18) immediately after induction heating (8) in case of continuous rolling (15) or is subject to an intermediate winding (16.1) before the final rolling.

6. Process according to claim 1, characterized in that the intermediate strip (5.3) is rolled in a controlled way through six passes in a finishing mill at a maximum to a finished hot rolled strip (13) with a minimum thickness of 0.4 mm and a temperature of transformation in a range at the exit of the finishing mill from the sixth pass of final rolling (18) in a range (24) between a minimum of 750° C. (AC1).

7. Process according to claim 6, characterized in that the intermediate strip (5.3) enters the finishing mill (18) at different speeds between 0.2 and 5.0 m/s.

8. Process according to claim 6, characterized in that between the sixth rolling pass and the coiling step, the finished hot rolled strip (13) is carried in a thermally controlled way and in the time to a final temperature higher than 200° C. through a thermally controlled management (14) according to the T.T.T. diagram (14.1).

9. Process according to claim 8, characterized in that the thermally controlled management (14) in the time of the hot finished strip (13) with a determined thickness and chemical composition (steel analysis) by means of a cooling strategy via a cooling line (19.1), (20.1, as well as to an isolation or heating line (20.3) based on the corresponding T.T.T. diagram (14.1) desired structures and properties of the material are obtained and consequently desired steel quality between the sixth rolling pass and the coiling step.

10. Process according to claim 9, characterized in that the finished hot rolled strip (13) is wound with the desired properties of the material.

11. Process according to claim 9, characterized in that the finished strip (13) with the desired properties of the material is directly brought to subsequent working steps (20.2) without preliminary winding.

12. Process according to claim 1, comprising a process control system (22) provided with specific parameters for the steel type quality according to the T.T.T. diagram (14.1) for a treatment rolling (14) of thermo-mechanical nature, consisting in a main master system (22.7) and six process subsystems (from 22.1 to 22.6) for programming, performing and controlling the process.

13. Production line for carrying out the process of claim 1, comprising a continuous casting machine (1), for the continuous casting of thin slabs (3) with a mould having a width of 2.2 m at maximum and an exit (or outlet) for a thickness of 100-70 mm of the slab at a position (3.1) immediately downstream of the mould exit having production lines connected thereto, namely:

a roughing mill (5) with not more than four rolling stands;

an induction heating path (8);

a finishing mill (18) with not more than six rolling stands;

at least one coiling station (20); and a cooling line between the finishing mill (18) and the coiling station (20), characterized by the fact that said continuous casting machine (1) is able to give a crowned shape of the cross section of the slabs, and the production line further comprising:

a roller table (3) for reducing the slab (3.1) thickness during solidification from 100 to 70 mm at the mould exit up to a solidification thickness (3.2) of 80-40 mm within the roller table itself at a casting speed of 10 m/mm;

a secondary spray cooling system (3B) by means of spray nozzles in correspondence with the casting machine (1);

said roughing mill (5) being equipped with rolls suitable to obtain a crown of up to 0.4 mm at each side;

said induction heating path (8) having a length of 40 m at maximum, immediately downstream of the roughing mill (5) with temperatures of intermediate strip (8.1) upon leaving said path (8) of 1100-1400° C. and suitable to control overheating of a head and tail of the intermediate strip by means of a temperature regulation algorithm; and a plastic stretching device (17) combined with a descaling device (17*a*), placed before said finishing mill (18), composed of a battery of upper and lower rolls in a total number of at least three.

14. Production line according to claim 13, characterized in that said roughing mill (5) is placed directly at the end of the continuous casting machine (1) at a distance of 10 m therefrom.

15. Production line according to claim 13, characterized in that immediately after the roughing mill (5) there is provided a shearing device.

16. Production line according to claim 15, characterized in that immediately after the transverse cutting device or shears (10) there is provided a cross-wise transportation device for the removal of plates from the intermediate strip.

17. Production line according to claim 13, characterized in that between the induction heating path (8) arid the plastic stretching device (17) there is provided an intermediate winding station (16.1) immediately upstream of the finishing mill (18).

18. Production line according to claim 13, characterized in that the distance between the stands of the finishing mill (18) is of 6 in at maximum.

19. Production line according to claim 13, characterized in that immediately after the last stand of the finishing mill (18) there is provided a coiling station (19) in the form of a carousel coiler, being preceded by an intensive cooling line (19.1).

20. Production line according to claim 19, comprising an additional conventional cooling line for hot rolled strip (20.1) with at least one downcoiler station (20) at the end of the production line.

21. Production line according to claim 20, characterized in that the cooling lines (19.1; 20.1) are equipped with an isolating line and/or an induction heating furnace (20.3).

22. Production line according to claim 13, characterized in that the hot rolled strip, being rolled and cooled according to a programmed thermo-mechanical rolling (14) is directly brought to the subsequent working line without preliminary coiling.

23. Production line according to claim 13, comprising a process control system (22) consisting in a "master" main system (22.7) and additional six peripheral subsystems (22.1-22.6) for programming, guiding and controlling the production line.

24. Production line according to claim 23, characterized in that the process control system (22) receives from a programming central computer system parameters depending on steel quality for thermo-mechanical rolling (14) according to the T.T.T. diagram (14.1), the hot rolled strip when leaving the finishing mill (18) has a temperature in a range AC3/AC1 (24) of said T.T.T. diagram (14.10 between 900 and 750° C.

* * * * *